United States Patent [19]

Fernandez

[11] Patent Number: 4,634,157

[45] Date of Patent: Jan. 6, 1987

[54] WINDOW GUARD AND LATCHING MECHANISM THEREFOR

[76] Inventor: Jesus S. Fernandez, 128 Glenn Heaven, Chula Vista, Calif. 92011

[21] Appl. No.: 637,317

[22] Filed: Aug. 3, 1984

[51] Int. Cl.[4] ..... E05C 3/04

[52] U.S. Cl. ..... 292/218; 49/56; 49/141

[58] Field of Search ..... 292/58, 59, 68, 56, 292/101, 213, 218, 252, 202, 356; 49/141, 56

[56] References Cited

U.S. PATENT DOCUMENTS 3,953,939 5/1976 Klein ..... 49/56

4,057,935 11/1977 Rohrberg et al. ..... 49/141 X 4,127,293 11/1978 Moreno ..... 292/251

FOREIGN PATENT DOCUMENTS 150047 5/1955 Sweden ..... 292/58

*Primary Examiner*—Richard E. Moore

*Attorney, Agent, or Firm*—Gausewitz, Carr & Rothenberg

[57] ABSTRACT

A window guard with concealed hinges and standoff members, one standoff member having therein a pin member configured for being engaged by a rotatable double cam cylinder on a shaft member extending through a bushing into the interior of the structure, with a door knob or door handle connected to the other side thereof for ready disengaging of the latch mechanism.

3 Claims, 4 Drawing Figures

WINDOW GUARD AND LATCHING MECHANISM THEREFOR

BACKGROUND OF THE INVENTION

The background of the invention will be discussed in two parts:

FIELD OF THE INVENTION

This invention relates to security latching mechanisms for security window guard devices and to a window guard device incorporating the same.

DESCRIPTION OF THE PRIOR ART

With the increase in crime, and particularly those crimes involving invasion of a building, such as a home, increasing attention has been given to security devices. One such device currently employed is the security window guard, generally constructed of wrought iron or the like, in a decorative manner, so as to enhance the appearance of the structure.

One drawback incident to the use of such window guards relates to the lack of ease with which it may be disengaged from the interior when confronted with an emergency, such as a fire within the building, which requires that the window be used as an exit.

One such device is shown and described in U.S. Pat. No. 4,111,477, entitled "Window Guard", issued Sept. 5, 1978 to Rigali. In the latching mechanism of this Patent, a tubular keeper is affixed to the guard frame, the keeper having a tapered opening with a circumferential recess for captively retaining ball bearings which are radially displaced from within a locking pin assembly by axial displacement of a specially configured spring biased release pin. The locking pin assembly extends through the wall of the structure for actuation from within. Such latching mechanisms are expensive, complicated in construction, and unless built to precise tolerances may tend to bind or become inoperable.

Accordingly, it is an object of the present invention to provide a new and improved window guard and latching mechanism therefor.

It is another object of the present invention to provide a new and improved window guard with a latching mechanism which is uncomplicated, inexpensive to construct and easy to operate from within the structure.

SUMMARY OF THE INVENTION

The foregoing and other objects of the invention are accomplished by providing a window guard with concealed hinges and dummy standoff members, one standoff member having therein a pin member configured for being engaged by a rotatable double cam cylinder on a shaft member extending through a bushing into the interior of the structure, with a door knob or door handle connected to the other side threreof for ready disengaging of the latch mechanism.

Other objects, features and advantages of the invention will become apparent from a reading of the specification, when taken in conjunction with the drawings, in which like reference numerals refer to like elements in the several views.

DESCRIPTION OF THE PREFERRED EMBOIDMENT

Figure 1:
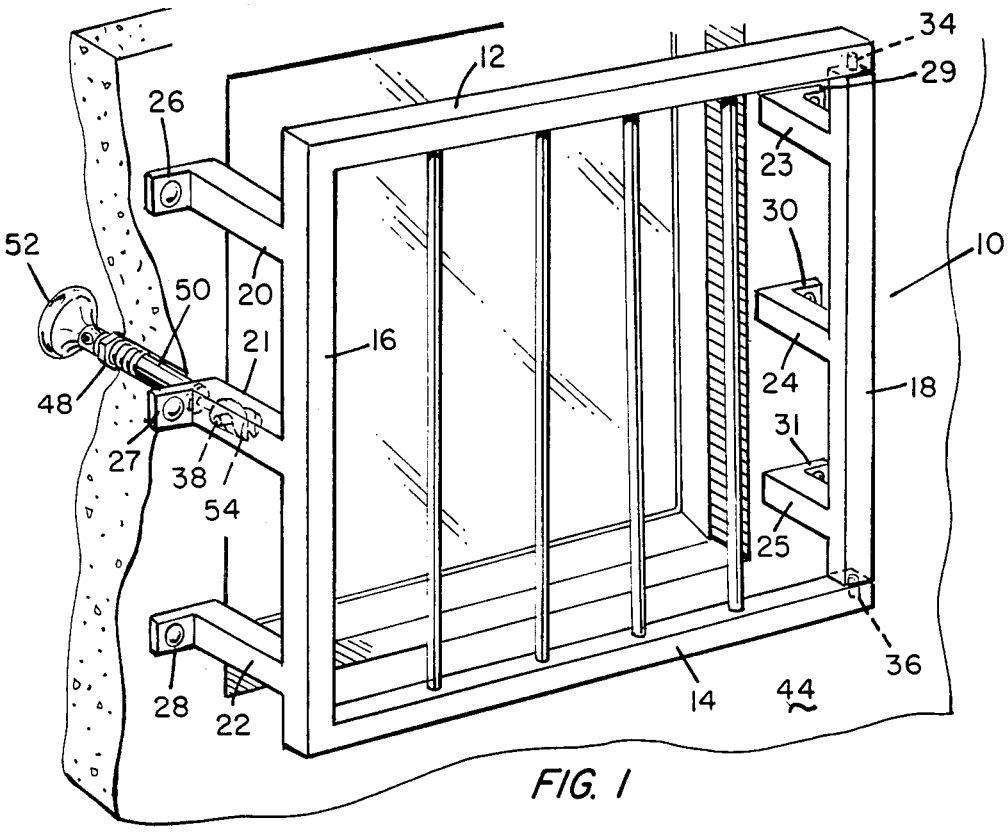
FIG. 1 is a perspective view of a window guard according to the invention.

Referring now to the drawings, and particularly to FIG. 1, there is shown a window guard, generally designated 10, the guard 10 being formed of generally rectangular tubing into a grid or framework including horizontal upper and lower frame members 12 and 14, and vertical side members 16 and 18, with intervening vertical bar members having a spacing sufficient to preclude physical entry.

Extending orthogonally from the side members 16 and 18 are a plurality of standoff members 20–25, each being of generally identical dimension and formed from rectangular or square tubing having a first end thereof suitably welded to the side members 16 and 18. The other end of each standoff member 20, and 22–25 is provided with a short perpendicularly extending plate member 26 and 28–31, respectively, secured thereto, with the heads of screws or bolts appearing on each of the plate members 26–28 of standoff members 20–22, respectively. The screws or bolts on plate members 26 and 28 are actual heads of screws or bolts, which have been cut and welded to the plate members 26 and 28 on the top surface thereof to provide the appearance of the gate 10 being physically secured to the wall via the plate members 26 and 28. The plate member 27 is physically separate from the standoff member 21 and, as will be described, forms a part of the latching mechanism.

The plate members 29–31 of the standoff members 23–24, respectively, have aperatures therethrough (not shown) for passage therethrough of bolts or screws (not shown) for attachment to the wall. These screws or bolts would have heads identical to the heads shown on plate members 26–28.

The vertical side member 18 has standoff members 23–25 suitably welded thereto and with this side fastened to the wall, side member 18 is in fixed relation to the wall. Hidden hinges are provide in cooperative relation with side member 18, with axially aligned vertically positioned hinge pins 34 and 36 secured thereto for engaging aligned openings formed in the coacting ends of upper and lower members 12 and 14, respectively, these openings being inwardly facing and concealed from view.

Figure 2:
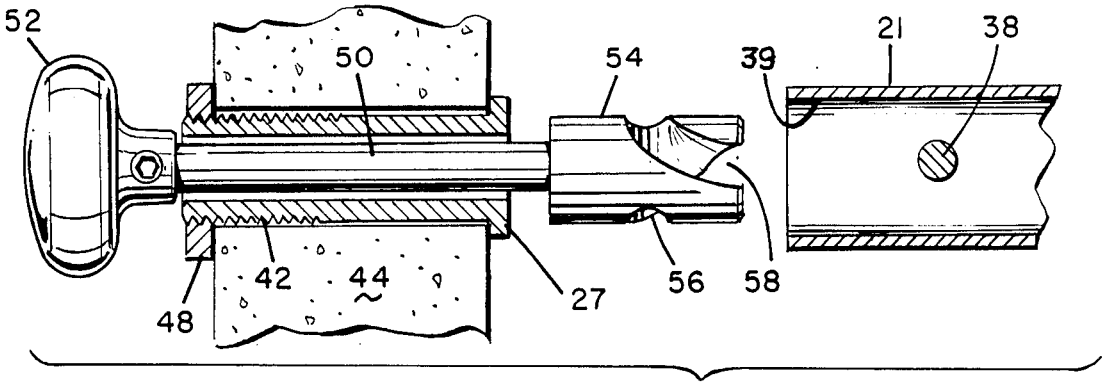
FIG. 2 is an exploded view of the operative components of the latching mechanism used in the window guard of FIG. 1.
Figure 3:
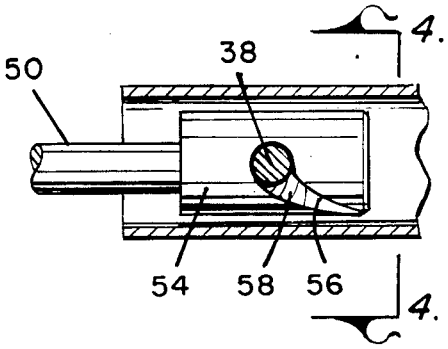
FIG. 3 is an exploded enlarged side elevational view of the engaging components of the latching mechanism of FIG. 1.
Figure 4:
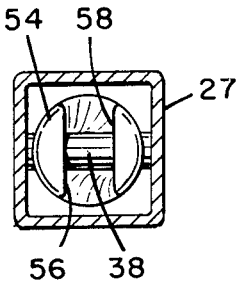
FIG. 4 is an end view of the engaging components of the latching mechanism of FIG. 3 as viewed along line 4—4 thereof.

Referring now also to FIGS. 2 through 4, the details of the latching mechanism will be described. The center standoff member 21 has a latch pin 38 extending transversely thereacross a short distance from the opening 39 thereof. This pin 38 is preferably formed of steel or the like and may be simply welded to the interior walls of the hollow standoff member 21, or may be part of a subassembly which is then inserted into the opening 39 and secured therein.

For coacting with the latching pin 38, the latch mechanism includes a bushing 42 passing through an opening in the wall 44, and suitably secured thereto. For example, the bushing 42 may be a tubular member having the plate member 27 secured to one end thereof, such as by welding, with the other end thereof threaded for receiving the lock nut 48 thereon.

A shaft member 50 is rotatably mounted within the bushing 42, one end of the shaft member 50 having a handle 52 attached thereto, and the other end having a latch cylinder 54 attached thereto. The latch cylinder 54 is a ground out generally solid cylindrical member having first and second open-ended cam slots 56 and 58 formed therein, the cam slots 56 and 58 being configured for engaging the latch pin 38 and, upon rotation of the latch cylinder 54, urging the standoff member 27 toward the wall until the respective components are in the fully engaged position indicated in FIGS. 3 and 4. Disengagement, by counterrotation of the handle 52 urges the standoff meber 27, along with the pivotable portion of the guard 10, outwardly for convenience of exit. The handle 52 is preferably formed in the size and shape of a door knob, or may be a European style door handle, either of which may be readily operable by a child or an elderly person, as well as an adult, without complication.

In accordance with the present invention, there has been shown and described a preferred embodiment of a security guard window apparatus and a latching mechanism therefor, the guard and latch being configured for concealing the existence of the latch while enabling ready use of the latch for escape purposes. It is to be understood that other modifications may be made without departing from the spirit and scope of the invention.

I claim:

1. In a security window apparatus, the combination comprising:

a generally rectangular frame means having generally parallel upper and lower frame members and first and second side members, said first side member being secured to said upper and lower frame members intermediate the ends thereof, and said second side member being hingedly secured to said upper and lower frame members, the hinged securement of said second side member including a pair of axially aligned hinge pins extending into complementary apertures in said upper and lower frame members for providing a concealed hinge;

standoff means secured to said second side member for attachment to a wall;

standoff means secured to said first side member, at least one of said standoff means having an opening therein, each of said standoff means lying in a plane generally perpendicular to the plane of said frame means, and the majority of said standoff means further includes a plate member attached generally perpendicular thereto, the standoff means of said first side member having apertures for passage therethrough of bolt means for securing to a wall, and at least some of the standoff means of said second side member having means secured thereto simulating the heads of the bolt means to provide the appearance of a connection to a wall;

latch means within said opening;

a latch mechanism having passage means configured for extending through and securing to a wall, said mechanism including a pivotable shaft member extending through said passage means, said shaft member having on one end thereof cam means for passage into said opening for engagement with said latch means and on the other end thereof handle means for pivoting said shaft member.

2. The combination according to claim 1 wherein said cam means includes a cylindrical member having first and second open ended cam slots therein.

3. The combination according to claim 2 wherein said latch means includes a pin member extending generally transverse to said opening.

* * * * *